US006347961B2

(12) United States Patent
Zhu et al.

(10) Patent No.: US 6,347,961 B2
(45) Date of Patent: Feb. 19, 2002

(54) ELECTRICAL CONNECTOR ASSEMBLY WITH IMPROVED SHIELDING STRUCTURE

(75) Inventors: ZiQiang Zhu; ZhongHua Yao; ZhiQuan Mou, all of KunSan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/730,032

(22) Filed: Dec. 4, 2000

(30) Foreign Application Priority Data

Jun. 3, 2000 (TW) ..... 089209516

(51) Int. Cl.[7] ..... H01R 13/648
(52) U.S. Cl. ..... 439/607; 439/541.5
(58) Field of Search ..... 439/607–610, 439/541.5, 79

(56) References Cited

U.S. PATENT DOCUMENTS 6,027,375 A * 2/2000 Wu ..... 439/607
6,165,015 A * 12/2000 Wu et al. ..... 439/607
6,238,241 B1 * 5/2001 Zhu et al. ..... 439/541.5
6,238,244 B1 * 5/2001 Yang ..... 439/607

* cited by examiner

*Primary Examiner*—Hien Vu
(74) *Attorney, Agent, or Firm*—Wei Te Chung

(57) ABSTRACT

An electrical connector assembly (1) comprises an insulative housing (10), a plurality of terminals (30, 31) within the housing and a shield (20) covering the housing. The shield comprises a first part (21), a second part (22) and a third part (23). A pair of hooks (216) extends downwardly and forwardly from a front and lower end of the first part. A pair of ears (223) is formed on opposite ends of a front edge of a top face of the second part and engages with the hooks. A spacing slot (13) and a hole (124) are defined in the housing. A pair of latches (225) separately extend from the top and a lower face of the second part and engage respectively with the spacing slot and the hole.

6 Claims, 6 Drawing Sheets

ELECTRICAL CONNECTOR ASSEMBLY WITH IMPROVED SHIELDING STRUCTURE

FIELD OF THE INVENTION

The present invention relates to an electrical connector assembly, and particularly to an electrical connector assembly having improved shielding members which can be reliably and efficiently assembled together and to a dielectric housing of the connector assembly.

BACKGROUND OF THE INVENTION

Taiwan Patent Application No. 85212192 discloses a related art Universal Serial Bus (USB) connector assembly. The USB connector assembly comprises an insulative housing, a plurality of terminals received in the housing, and shielding plates covering and shielding the housing. The housing comprises an upper body, a lower body and a partition formed between the upper body and the lower body and substantially separating the upper body and the lower body. The terminals are separately assembled in the upper body and the lower body of the housing. The shielding plates comprise an outer plate covering the housing, a clip plate fitted to the partition for preventing electromagnetic interference between the terminals respectively assembled in the upper body and the lower body of the housing, and a back plate attached to a back of the housing. A pair of latches on opposite sides of the clip plate clamp side portions of the outer plate. However, the assembly of the shielding plates is not secure enough to provide an integral and reliable shielding of the electrical connector assembly. Furthermore, the assembling thereof is laborious and inconvenient, causing the assembly efficiency to be poor.

Hence, an improved shielding structure for an electrical connector assembly is required to overcome the disadvantages of the prior art.

BRIEF SUMMARY OF THE INVENTION

A first object of the present invention is to provide an electrical connector assembly having a separable shield part, which can be interchangeably used with an independent conventional connector, therefore saving manufacturing cost and facilitating management of parts inventory.

A second object of the present invention is to provide an electrical connector assembly having improved shielding parts which can be more securely engaged with one another.

A third object of the present invention is to provide an electrical connector assembly which is easy to assemble.

An electrical connector assembly in accordance with the present invention comprises an insulative housing having an upper body and a lower body, a plurality of terminals secured within the insulative housing, and a shield covering the housing. The shield comprises a first part, a second part and a third part. The upper body and the lower body of the housing are respectively secured in the first and second parts. The third part covers a back of the housing and is assembled together with the first and second parts. A pair of recess portions is defined in opposite side faces of the lower body. A pair of lower flaps is correspondingly formed on opposite side faces of the first part for being received in the recess portions of the housing. A pair of hooks extends downwardly and forwardly from a front and lower end of both side faces of the first part. A pair of ears is formed on opposite ends of a front edge of a top face of the second part for being engaged with the hooks of the first part. A spacing slot and two slots are defined between the upper body and the lower body of the housing, and a hole is defined in the lower body of the housing. A pair of latches separately extends from the top face and a lower face of the second part for being engaged with the spacing slot and the hole of the housing. A pair of protrusions extends from the top face of the second part for being engaged with the slots of the housing. A pair of clips and a pair of resilient tabs formed on the third part respectively engage with a pair of securing holes of the first part and a pair of rectangular holes of the second part.

DETAILED DESCRIPTION OF THE INVENTION

Figure 1:
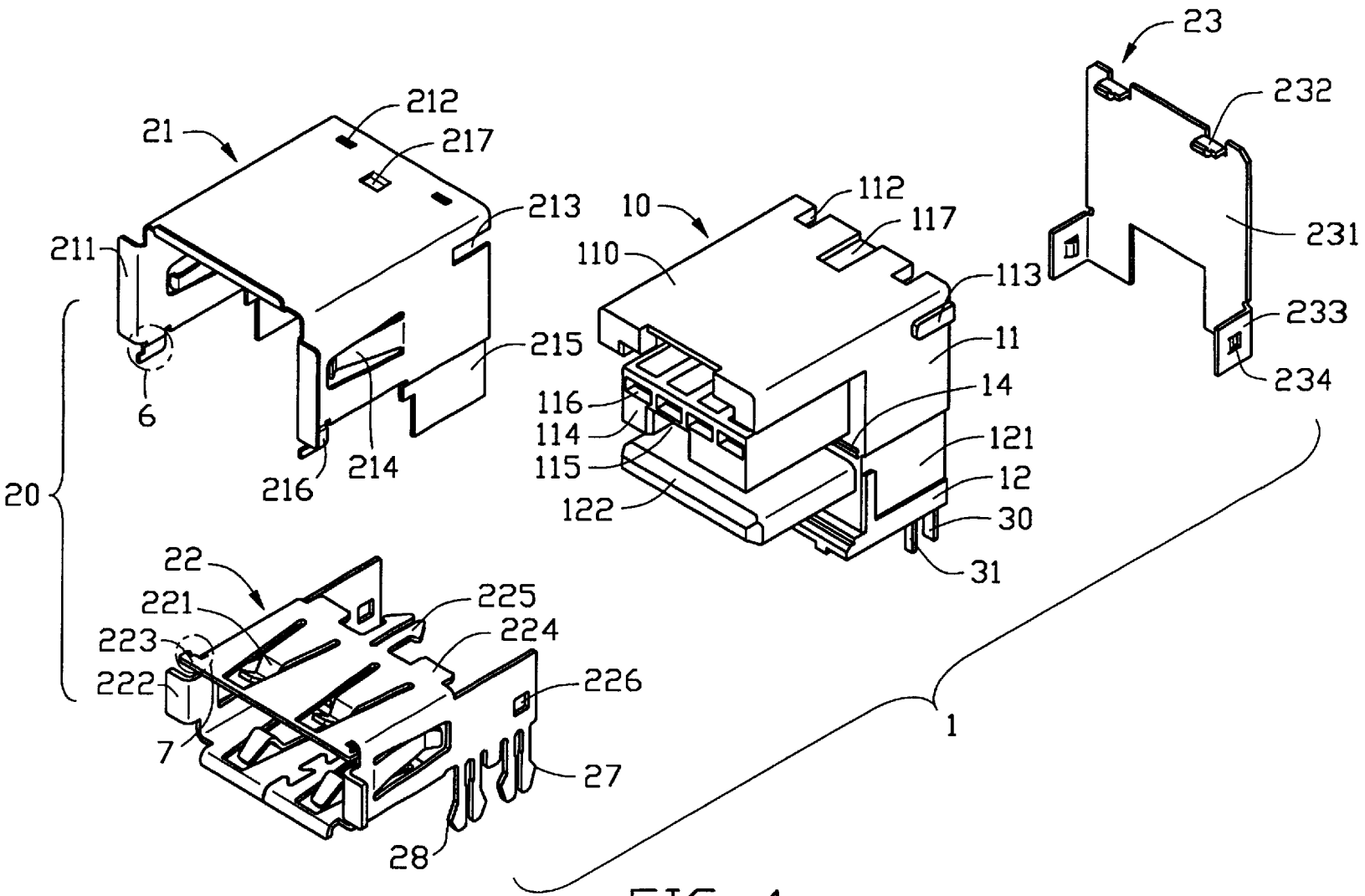
FIG. 1 is an exploded view of an electrical connector assembly of the present invention.
Figure 2:
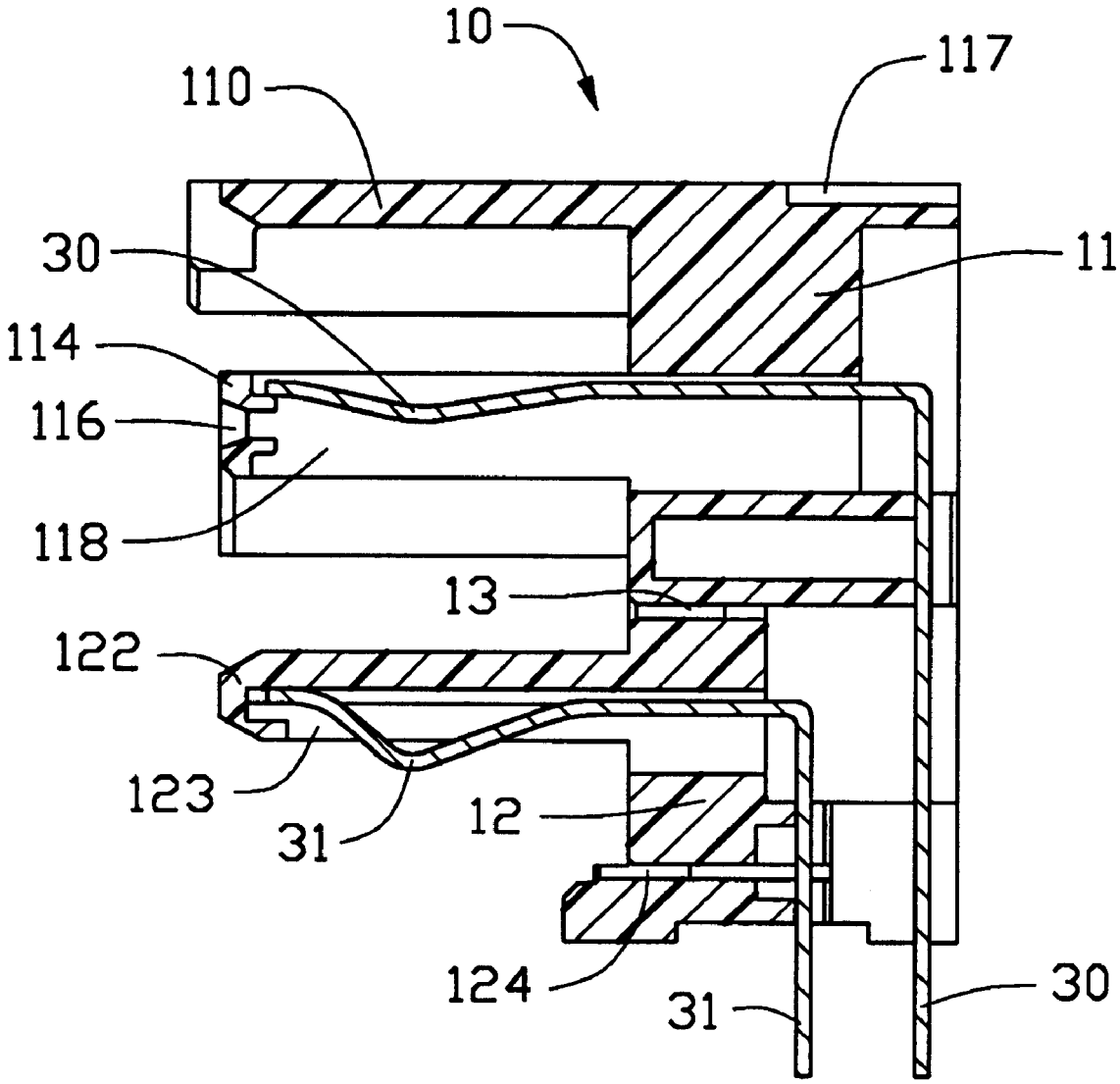
FIG. 2 is a cross-sectional view of the electrical connector assembly with a shield thereof removed.

Referring to FIGS. 1 and 2, an electrical connector assembly 1 comprises an insulative housing 10, a shield 20, and a plurality of terminals 30, 31.

Figure 4:
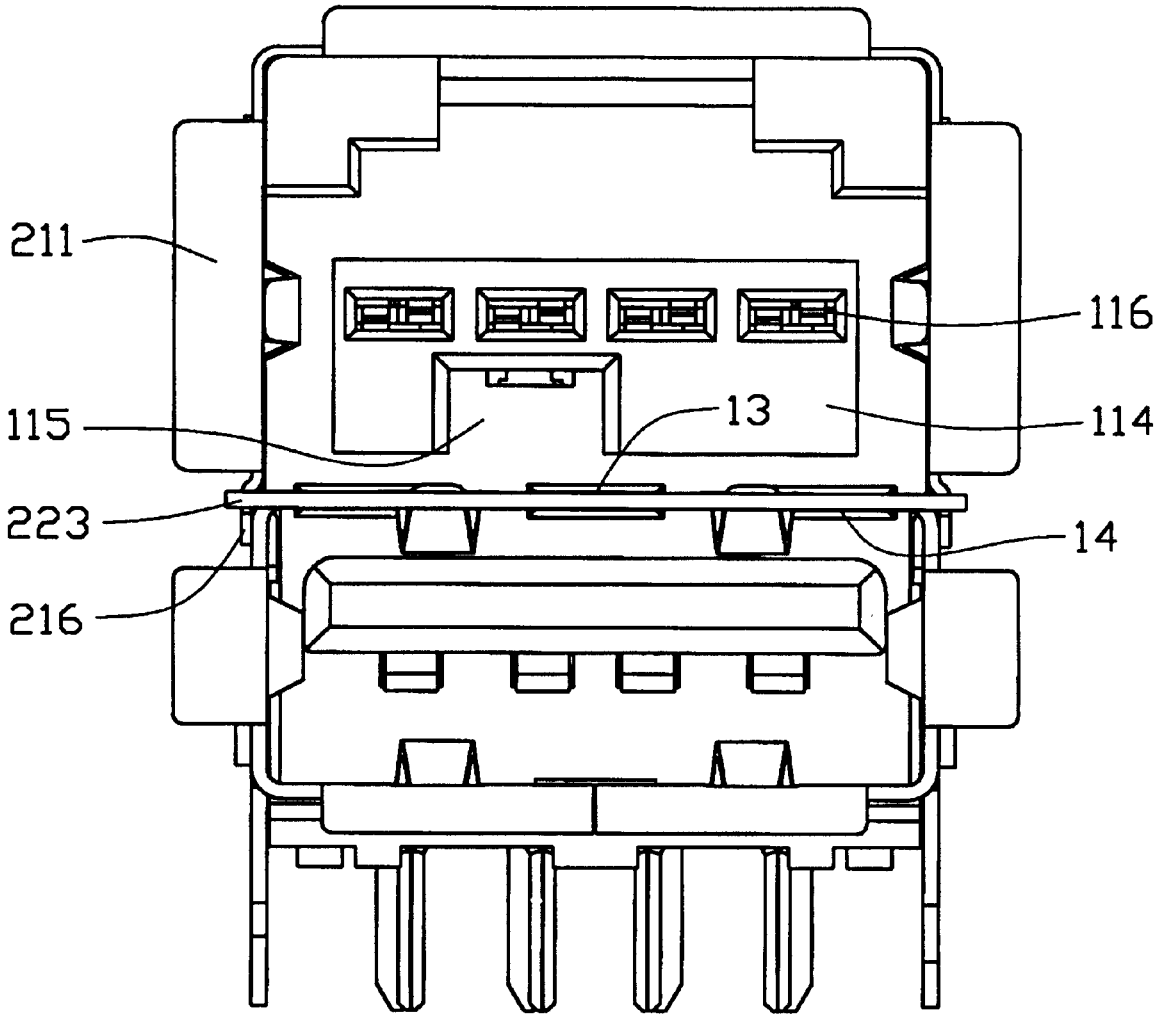
FIG. 4 is a front view of FIG. 3.

The insulative housing 10 comprises an upper body 11 and a lower body 12 below the upper body 11. Referring to FIGS. 2 and 4, the upper body 11 has a flat upper wall 110. A spacing slot 13 and two slots 14 are defined between the upper body 11 and the lower body 12 (also referring to FIG. 4). The upper body 11 defines two channels 112 and a groove 117 between both channels 112 at a rear end of the flat upper wall 110. The upper body 11 further forms a pair of protrusions 113 on opposite side faces (not labeled) thereof neighboring a rear face of the insulative housing 10. The lower body 12 defines a pair of recess portions 121 in opposite side faces (not labeled) thereof. A first socket 114 and a second socket 122 respectively extend forwardly from an inner portion of the upper body 11 and the lower body 12. The first socket 114 defines a recess 115 for avoiding a disorientation of the connector assembly 1 with a complementary connector (not shown) when they are mated together. The first socket 114 further comprises a mating portion 116 that defines a plurality of terminal receiving channels 118 for receiving corresponding terminals 30 therein. The second socket 122 defines a plurality of terminal passageways 123 for receiving corresponding terminals 31 therein. Particularly referring to FIG. 2, the lower body 12 further defines a hole 124 in a lower portion thereof.

The shield 20 comprises a first part 21 for shielding the upper body 11, a second part 22 for shielding the lower body 12, and a third part 23 for shielding the rear face of the insulative housing 10.

Figure 6:
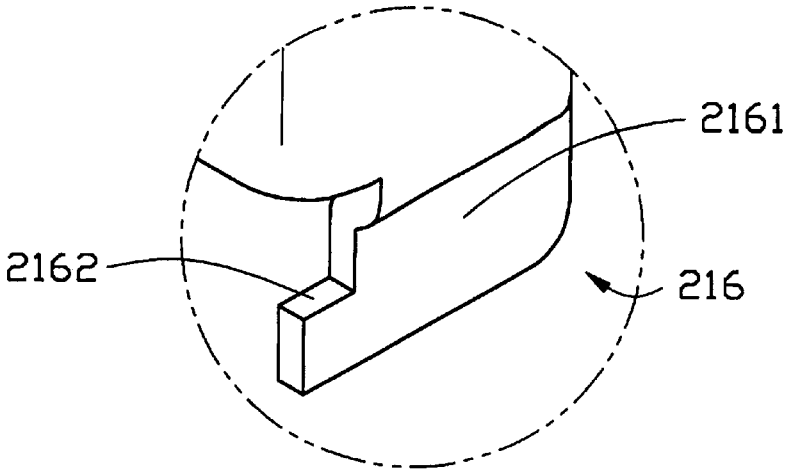
FIG. 6 is an enlarged view of a portion of FIG. 1 indicated by a circle 6 in phantom lines.

The first part 21 has a top face (not labeled) and a pair of side faces (not labeled) connected to the top face. A flared portion 211 is formed on a front edge of the top face and each side face of the first part 21 for facilitating an insertion of the complementary connector into the connector assembly 1. The top face defines two securing holes 212 at a rear end thereof and forms a tab 217 between the securing holes 212. The securing holes 212 and the tab 217 are correspondent to the channels 112 and the groove 117 of the housing 10, respectively. The side faces each define a channel 213 at a rear end thereof corresponding to one of the protrusions 113 of the housing 10. A resilient arm 214 curves forwardly and inwardly from a middle of each side face. The side faces of the first part 21 further form a pair of lower flaps 215 corresponding to the recess portions 121 of the lower body 12, and a pair of hooks 216 extending downwardly and forwardly from a front and lower end thereof. Each hook 216 has an L-shape with a vertical side 2161 and a horizontal tab 2162 (referring to FIG. 6).

Figure 5:
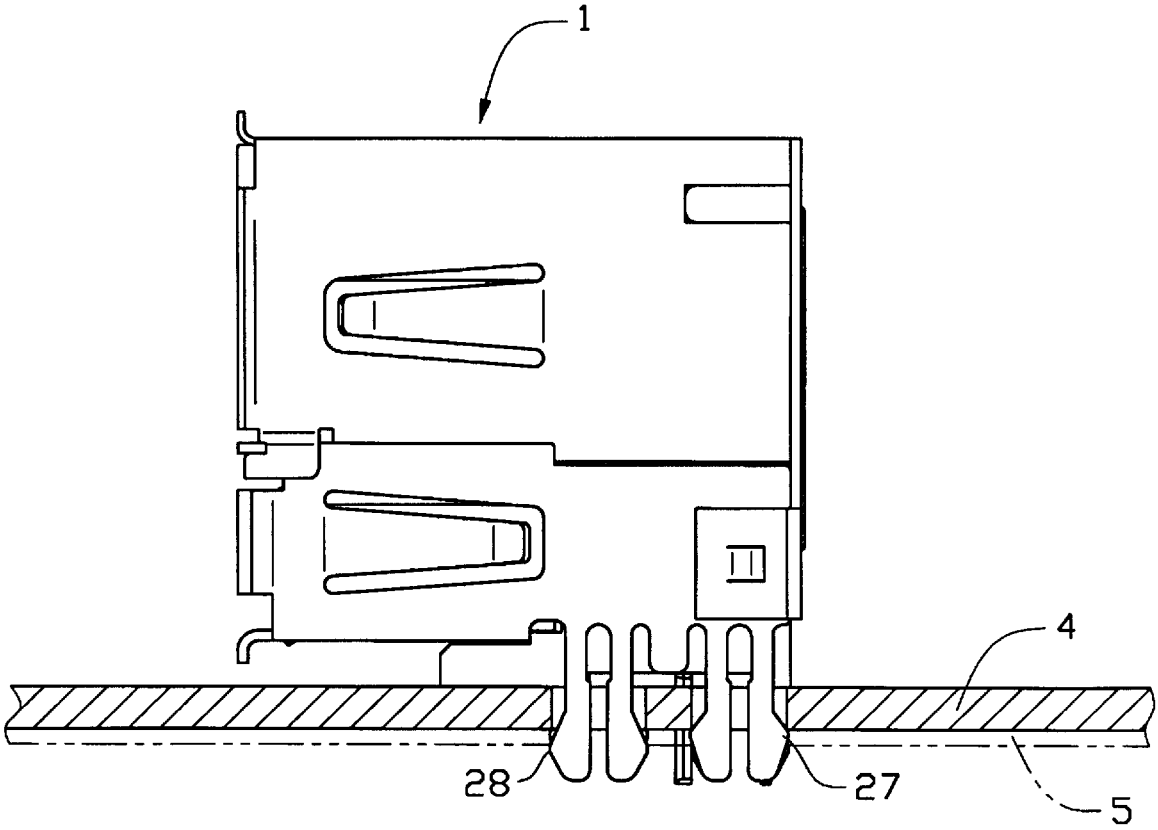
FIG. 5 is a side view of the electrical connector shown in FIG. 3 assembled to two printed circuit boards having different thickness.
Figure 7:
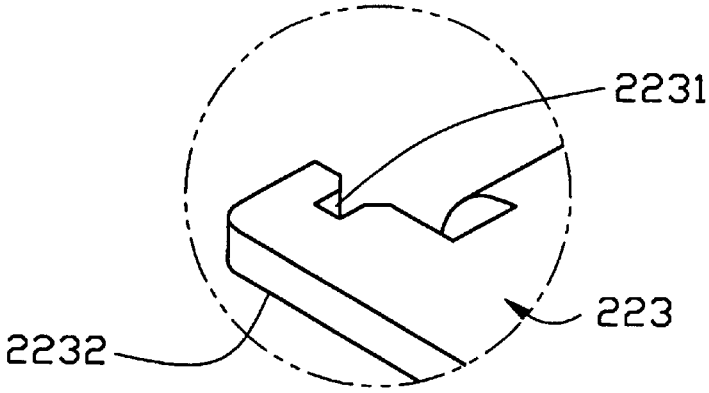
FIG. 7 is an enlarged view of a portion of FIG. 1 indicated by a circle 7 in phantom lines.
Figure 8:
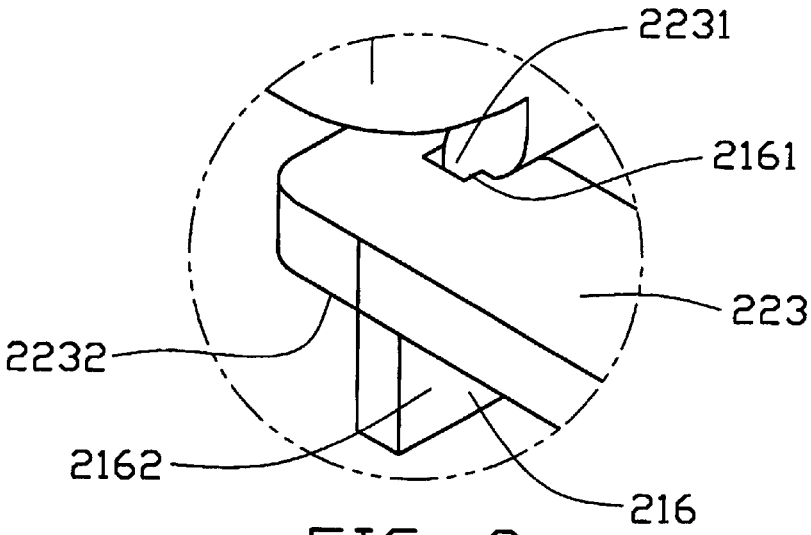
FIG. 8 is an enlarged view of a portion of FIG. 3 indicated by a circle 8 in phantom lines.

The second part 22 is bent from a metal plate to form the shape of a rectangular tube. The second part 22 comprises a top face (not labeled), a lower face (not labeled), and two side faces (not labeled) connecting the top face and the lower face to form a hollow therebetween. The top face, the lower face, and the side faces each form at least a resilient arm 221 projecting inwardly into the hollow. A flared portion 222 is formed on a front edge of each side and lower face of the second part 22 for facilitating an insertion of a mating connector into the connector assembly 1. The top face forms a pair of ears 223 outwardly extending on opposite ends of a front edge thereof and corresponding to the hooks 216 of the first part 21. The ears 223 each include a notch 2231 in a rear edge thereof and a bottom face 2232 (FIG. 7). The top face of the second part 22 forms two protrusions 224 and a latch 225 projecting rearwards from a rear edge thereof, wherein the latch 225 is located between the two tabs 224. The protrusions 224 are correspondent to the slots 14 of the insulative housing 10 and the latch 225 is correspondent to the spacing slot 13 of the insulative housing 10. The lower face of the second part 22 also forms a latch (not shown) having a structure identical to the latch 225 and projecting rearwardly from a rear edge thereof for latching into the hole 124 of the lower body 12. In addition, the side faces of the second part 22 each define a rectangular hole 226 in a rear edge thereof and each form a pair of first locking legs 27 and a pair of second locking legs 28 for alternatively securing the connector assembly 1 on one of printed circuit boards 4, 5 having different thickness (FIG. 5). Details of the locking legs 27, 28 and their interaction with the printed circuit boards 4, 5 are disclosed in co-pending U.S. patent application Ser. No. 09/690,105 filed on Oct. 16, 2000. The disclosures of that patent application are wholly incorporated herein for reference.

The third part 23 is also made from a metal plate, and forms two clips 232 projecting forwardly from an upper edge of a main plate 231, the clips 232 corresponding to the securing holes 212 of the first part 21. An engaging plate 233 extends forwardly from a lower portion of each of opposite side edges of the main plate 231. Each engaging plate 233 forms a resilient tab 234 corresponding to the rectangular hole 226 of the second part 22.

Figure 3:
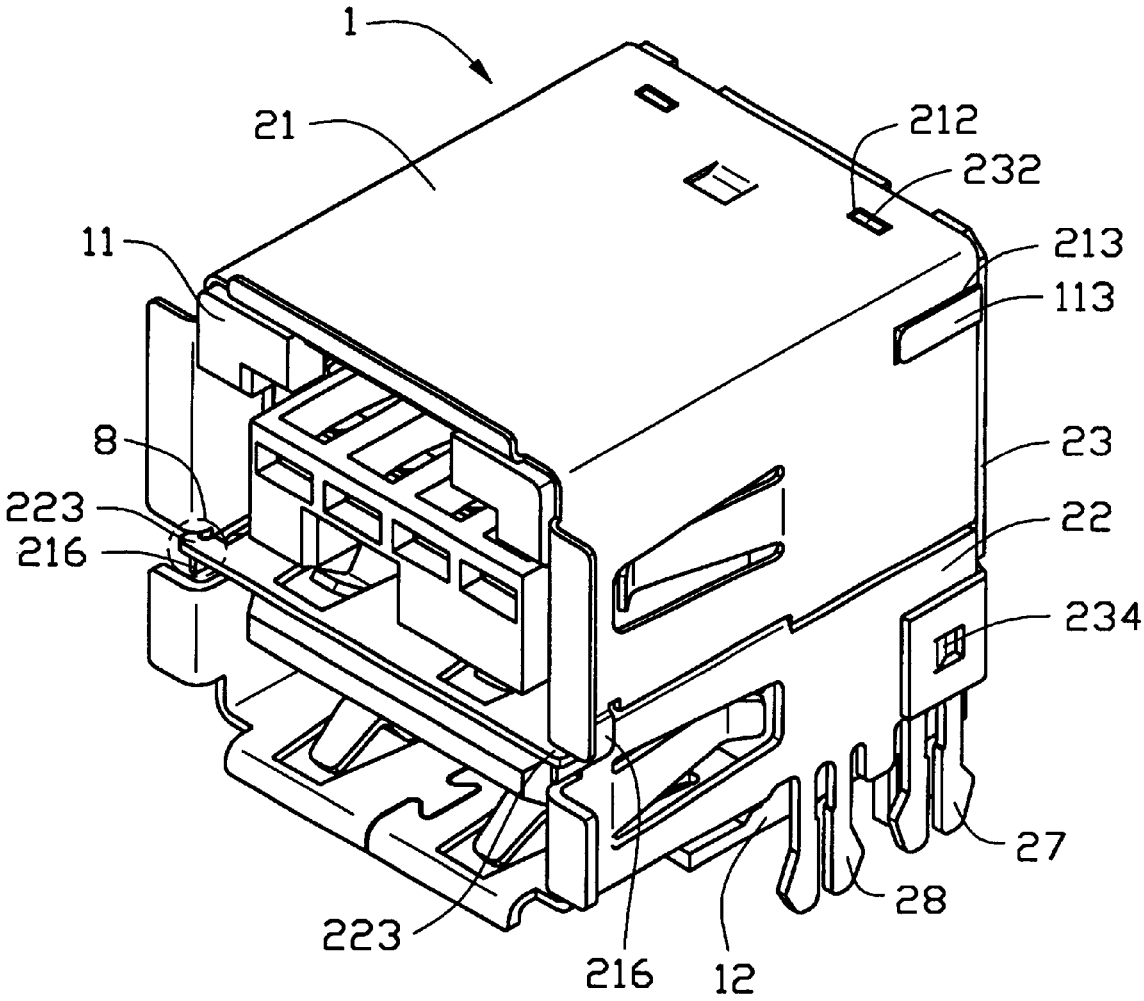
FIG. 3 is a perspective assembled view of the present invention.

Referring to FIGS. 3 and 4, in assembly, the first part 21 is first assembled to the upper body 11 with the channels 213 and the tab 217 respectively engaging with the protrusions 113 and the groove 117, and the lower flap 215 being received into the recess portion 121. The second part 22 is then assembled to the lower body 12 with the latch 225 and the protrusions 224 respectively extending into the spacing slot 13 and the slots 14 of the insulative housing 10 for positioning the second part 22 against the housing 10. The latch 225 has an interferential engagement with the housing 10, thereby securing the second part 22 with the housing 10. The latch of the lower face of the second part 22 extends into the hole 124 of the lower body 12 and engages with an inner wall of the hole 124. When the first part 21 and second part 22 of the shield 20 are assembled, the vertical side 2161 of the prickle 216 fits into the notch 2231 and the horizontal tab 2162 abuts against the bottom face 2232 of the ear 223, thereby more securely connecting the first and second parts 21, 22 together and providing an electrical connection between the two parts 21, 22. The side faces of the second part 22 clamp the lower flaps 215 of the first part 21. Finally the third part 23 is brought to cover the rear face of the insulative housing 10 with the clips 232 engaging with the securing holes 212 and the resilient tabs 234 engaging with the rectangular holes 226, thereby assembling the shield 20 and the housing 10 together to complete the electrical connector assembly 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted for fixing to a printed circuit board and mating with a complementary connector, comprising:

an insulative housing comprising an upper body and a lower body respectively forming a first socket and a second socket;

a plurality of terminals respectively secured within the first and second sockets;

a shield enclosing the insulative housing and comprising a first part covering the upper body, a second part enclosing the lower body, and a third part covering a rear ace of the insulative housing; and a pair of hooks being respectively formed on side faces of the first part, a pair of ears being formed on the second part, and the hooks being fittingly engagable with the cars to securely connect the first and second parts together and to provide an electrical connection between the first and second parts; wherein the second part forms a latch on a top face thereof, a spacing slot is defined between the upper and lower bodies, and the latch is received in the spacing slot and has an interferential engagement with the housing; wherein a pair of protrusions extends rearwardly from the top face of the second part, a pair of slots is defined beside the spacing slot, and the protrusions extend into the slots for positioning the second part against the housing; wherein the upper body has two protrusions on side faces thereof, and a groove in a top face thereof, and the first part of the shield defines two channels in a rearward side of its side faces and forms a downwardly projecting tab in a top face, and the channels fittingly receive the protrusions of the upper body and the tab is received in the groove; wherein the third part forms at least one clip engaging with a hole defined in a top face of the first part.

2. The electrical connector assembly as claimed in claim 1, wherein each of the hooks includes an L-shaped front end with a vertical side and a horizontal tab and each of the ears includes a notch and a bottom face.

3. The electrical connector assembly as claimed in claim 2, wherein the vertical side of each hook fits into a corresponding notch and each horizontal tab abuts against a corresponding bottom face of the ears.

4. The electrical connector assembly as claimed in claim 1, wherein the lower body defines a pair of recess portions in opposite side faces thereof and the side faces of the first part each form a lower flap which is received in a corresponding recess portion of the lower body.

5. The electrical connector assembly as claimed in claim 4, wherein the second part has two side faces clamping the lower flaps of the first part.

6. The electrical connector assembly as claimed in claim 5, wherein the third part has two forwardly extending engaging plates, each fittingly engaging with a corresponding side face of the second part.

* * * * *